US005794815A

United States Patent [19]

Carlson et al.

[11] Patent Number: 5,794,815

[45] Date of Patent: Aug. 18, 1998

[54] DISPENSERS WITH OPTIONAL SUPPORT OR ATTACHMENT MEANS

[75] Inventors: Casey L. Carlson, Edina; Daniel E. Siltberg, White Bear Township, both of Minn.

[73] Assignee: Minnesota Mining and Manufacturing Company, St. Paul, Minn.

[21] Appl. No.: 667,527

[22] Filed: Jun. 19, 1996

[51] Int. Cl.[6] ..... A47K 10/24

[52] U.S. Cl. ..... 221/45; 221/282

[58] Field of Search ..... 221/45, 46, 33, 221/185, 52, 281, 282, 63

[56] References Cited

U.S. PATENT DOCUMENTS

| | | | |
|---|---|---|---|
| 4,907,825 | 3/1990 | Miles et al. | 281/51 |
| 5,014,946 | 5/1991 | Gruber | 248/206.5 |
| 5,086,946 | 2/1992 | Blackwell et al. | 221/45 |
| 5,299,712 | 4/1994 | Carlson et al. | 221/45 |
| 5,516,581 | 5/1996 | Kreckel et al. | 428/317.3 |
| 5,518,144 | 5/1996 | Samuelson et al. | 221/33 |
| 5,526,955 | 6/1996 | Windorski et al. | 221/34 |

*Primary Examiner*—Kenneth Noland
*Attorney, Agent, or Firm*—William L. Huebsch

[57] ABSTRACT

An assembly including a dispenser for flexible sheets from a stack, which dispenser has manually separable top and bottom portions defining a cavity therebetween adapted to receive the stack so that the uppermost sheet in the stack can be manually pulled through an opening in the top wall. The assembly can further include one or more of (1) a support member having opposed hook-like distal end portions extending through openings in and engaging the dispensers bottom wall, which support member has finger engagement surfaces shaped to engage adjacent side surfaces of a user's fingers and includes a narrow web like portion between the finger engagement surfaces adapted to comfortably extend between the fingers of a user positioned along the finger engagement surfaces, and includes a retainer portion wider than the web like portion adapted to be positioned along the inner surfaces of a user's fingers that can be releasably engaged with a weighted base to support the support member and dispenser on the base; (2) a resiliently elastic strap having hook-like members fixed to its opposite ends adapted to engage the bottom wall to support the dispenser on a users hand; and (3) weighted and un weighted bases having recesses in which the dispenser can be received.

24 Claims, 7 Drawing Sheets

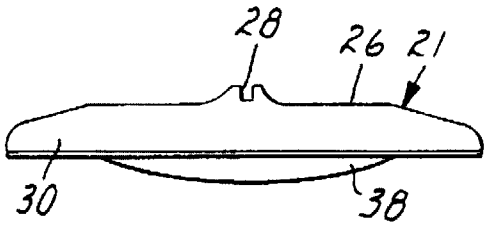
FIG. 2
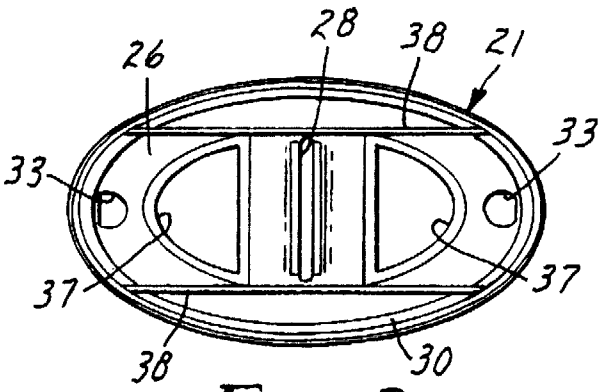
FIG. 3
FIG. 1
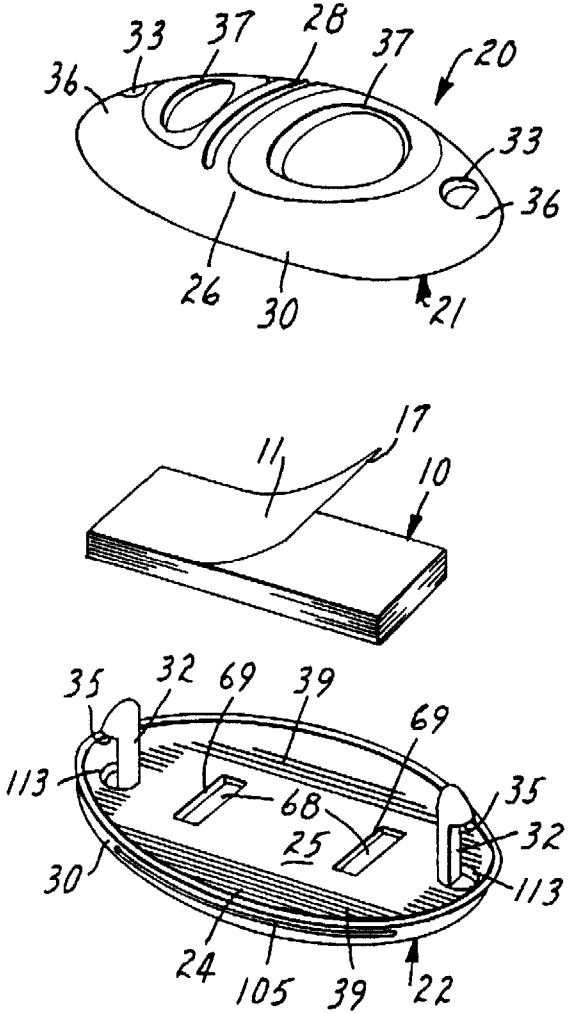

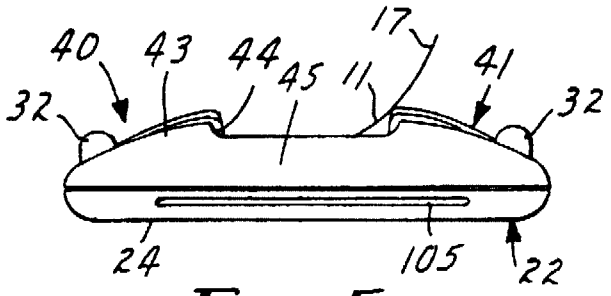
FIG. 5
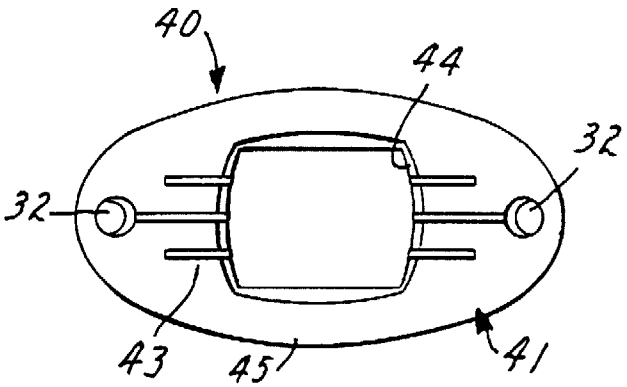
FIG. 6
FIG. 4
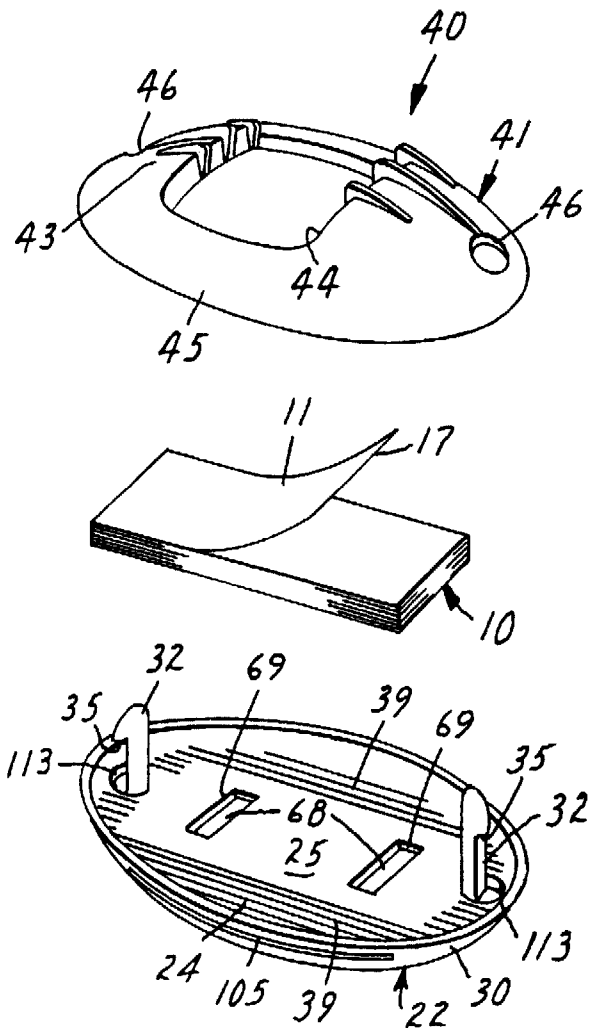

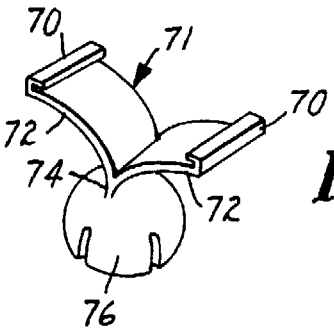
FIG. 10
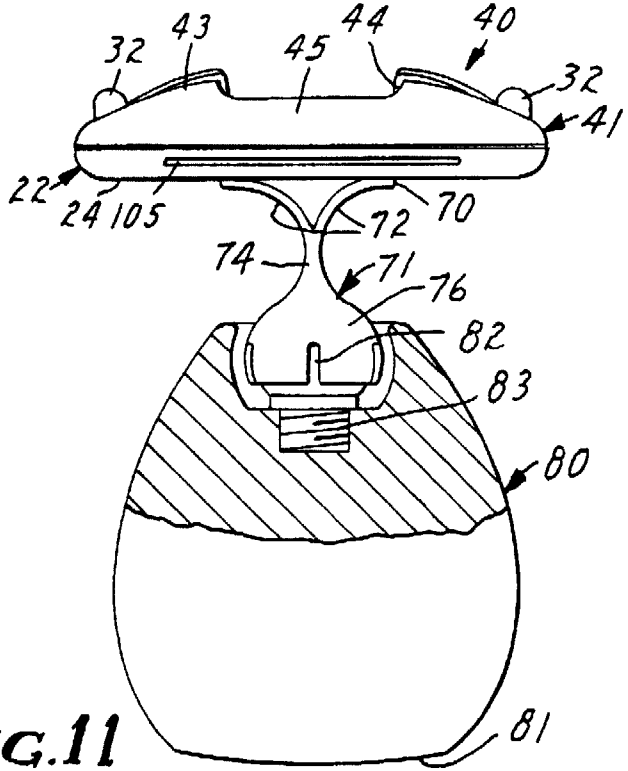
FIG. 11
FIG. 9
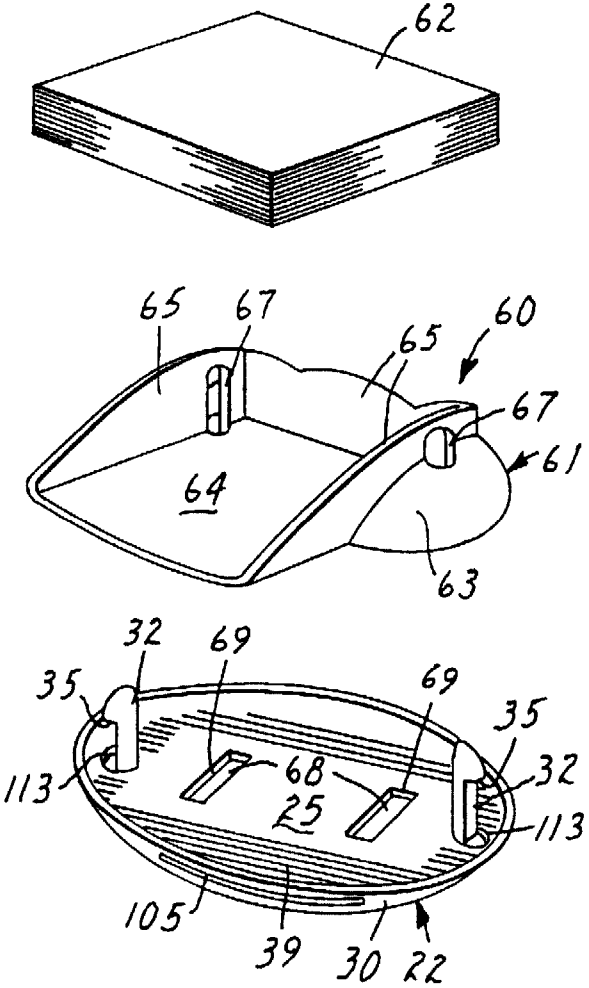

DISPENSERS WITH OPTIONAL SUPPORT OR ATTACHMENT MEANS

TECHNICAL FIELD

The present invention relates generally to dispensers for pressure sensitive adhesive coated sheets and retaining means to which such dispensers can be attached to releasably retain them at predetermined locations.

BACKGROUND ART

Refillable dispensers adapted to dispense pressure sensitive adhesive coated sheets are known, as are retaining means to which such dispensers can be attached to releasably retain them at predetermined locations. U.S. Pat. No. 5,086,946 issued Feb. 11, 1992, (Blackwell et al, the content whereof is incorporated herein by reference) describes such a dispenser, and includes a discussion of the background art relating to such dispensers. U.S. Pat. No. 5,526,955 issued Jun. 18, 1996, (Windorski et al, the content whereof is incorporated herein by reference) also describes such a dispenser.

U.S. Pat. No. 5,299,712 issued Apr. 5, 1994, (Carlson et al,the content whereof is incorporated herein by reference) describes a dispenser from which sheets in a stack of sheets of the type described in U.S. Pat. Nos. 5,086,946 (Blackwell et al) or 4,907,825 (Miles et al, the content whereof is incorporated herein by reference) can be dispensed, together with improved and novel retaining means to which the dispenser can be attached, and by which the dispenser can be positioned at predetermined locations, such as along the back of a user's fingers, hand, or wrist, or along a vertical or horizontal surface.

DISCLOSURE OF THE INVENTION

The present invention provides additional improvements in dispensers by which sheets can be dispensed from a stack of sheets of the type described in U.S. Pat. Nos. 5,086,946 (Blackwell et al) or 4,907,825 (Miles et al) or from a stack of "Post-it"™ brand notes, together with improvements in retaining means to which the dispenser can be attached, and by which the dispenser can be positioned at predetermined locations, such as along the back of a user's fingers, hand, or wrist, or along a vertical or horizontal surface.

According to the present invention there is provided an assembly comprising (1) a dispenser for flexible sheets from a stack of sheets disposed one on top of another that has a support surface adapted for supporting the stack of sheets; (2) a support member including attaching means for releasably attaching the support member to the side of a bottom wall of the dispenser opposite the support surface, which support member includes a retainer portion defining a socket opening through the side of the retainer portion opposite the attachment means, and (3) a heavy weighted base having an arcuate bottom surface adapted to be supported on a horizontal surface, and a spherical portion on the side of the base opposite the arcuate bottom surface removably received in the socket with the retainer portion frictionally and releasably engaging the spherical portion, which base has sufficient weight so that the sheets can be removed from the dispenser with one hand, while the retainer portion is easily removable from the base by pulling it off of the spherical portion so that the dispenser can be used at another location.

The dispenser can have top and bottom portions positionable in a closed position to define a cavity therebetween in which the stack of sheets is positioned, with the top portion having an outlet opening through which sheets are withdrawn. Those portions are separable to afford positioning the stack of sheets within the cavity, and means are provided for releasably retaining the housing portions in their closed position. The means for releasably retaining the housing portions in their closed position can include hooks projecting from one portion and openings receiving the hooks in the other, with the hooks and surfaces defining the openings having attaching portions in engagement to attach the housing portions together and the hooks being resiliently flexible in the openings to afford separation of the attaching portions and separation of the housing portions.

Alternatively, the dispenser can define the support surface for the stack along its outer surface, and can include walls having surfaces projecting generally normal to that support surface along three of its edges to protect the edges of the stack of sheets while being free of projecting portions along one of its edges to afford access to the stack of sheets on the support surface so that the sheets in the stack can be manually removed.

The support member can have finger engagement surfaces that face in opposite directions on opposite sides of the support member and are shaped to engage adjacent side surfaces of a user's fingers and can include a narrow web like portion between the finger engagement surfaces adapted to comfortably extend between the fingers of a user positioned along the finger engagement surfaces. The retainer portion is then wider than the web like portion and is adapted to be positioned along the inner surfaces of a user's fingers.

The assembly can further include an resiliently elastic strap having hook-like members fixed to its opposite ends that are adapted to engage openings in the bottom wall of the dispenser when the dispenser is separated from the support member to afford supporting the dispenser on a users hand with the strap extending around the side of the users hand opposite the dispenser.

Additionally, the assembly can include a light mountable base having a planar attachment surface adapted to be attached to a substrate, and surfaces defining a recess along its opposite side in which the dispenser can be received. The base has ridges projecting into the recess and adapted to be engaged in the grooves in the dispenser by sliding the dispenser over said ridges, and a transverse surface extending between corresponding ends of said ridges adapted to be engaged by the dispenser slid over said ridges to define full engagement of the dispenser in the recess. Also, the assembly can include a heavy base adapted to receive the dispenser in the same way that is adapted to be supported on a horizontal surface, which weighted base, in addition to the dispenser described above, can also be adapted to alternatively receive and releasably engage a light weight roll tape dispenser for dispensing tape from a roll.

In a simpler form, an assembly according to the present invention intended to dispense sheets from only one stack can include a dispenser with top and bottom portions and the stack of flexible sheets in a cavity between the portions, with the bottom portion comprising a planar generally rectangular bottom wall, the top portion including an arcuate top wall having an outlet opening for the cavity through which sheets from the stack can be manually pulled, a generally oval side wall, and a flange projecting, from the side of the side wall opposite the top wall and attached to the bottom wall so that the dispenser has corner portions of the bottom wall projecting beyond the side wall. That assembly can also include a mounting bracket including a rear wall having a planar attachment surface adapted to be attached to a planar substrate, and a front wall spaced from the side of the rear wall opposite the attachment surface with opposed surfaces of those walls defining a socket closely receiving at least two of the corner portions of the dispenser with the front wall having a through opening in which the top portion is positioned so that the outlet opening, is accessible along the top portion. That dispenser is then engageable with or removable from the mounting bracket by sliding its corner portions into or out of the socket.

BRIEF DESCRIPTION OF THE DRAWING

The present invention will be further described with reference to the accompanying drawing wherein like reference numerals refer to like parts in the several views, and wherein:

FIG. 1 is an exploded perspective view of a first embodiment of a sheet dispenser and a stack of sheets included in the assembly according to the present invention;

FIG. 2 is a side view of a top portion included in the sheet dispenser of FIG. 1;

FIG. 3 is a bottom view of the top portion of FIG. 2;

FIG. 4 is an exploded perspective view of a second embodiment of a sheet dispenser and a stack of sheets included in the assembly according to the present invention;

FIG. 5 is a side view of the dispenser of FIG. 4;

FIG. 6 is a top view of the dispenser of FIG. 4;

FIG. 9 is an exploded perspective view of a fourth embodiment of a sheet dispenser and a stack of sheets included in the assembly according to the present invention;

FIG. 10 is a perspective view of a support member included in the assembly according to the present invention;

FIG. 11 is a side view of the dispenser of FIG. 4 attached by the support member of FIG. 10 to a first embodiment of a base included in the assembly according to the present invention, which base has a part broken away and sectioned to show detail;

DETAILED DESCRIPTION

Figure 7:
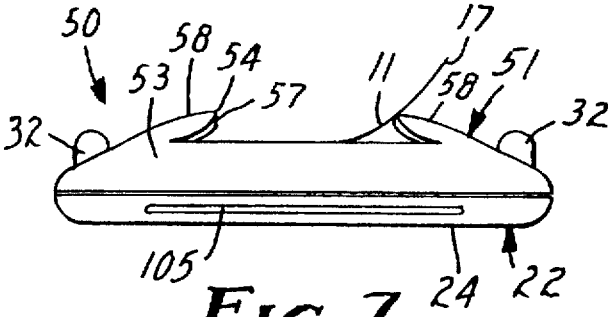
FIG. 7 is a side view of a third embodiment of a sheet dispenser included in the assembly according to the present invention.

Referring now to FIGS. 1, 2 and 3 of the drawing there is shown a first embodiment of a dispenser according to the present invention generally designated by the reference numeral 20. The dispenser 20 is particularly adapted for dispensing flexible sheets 11 from a stack 10 of sheets of the types described in U.S. Pat. No. 4,907,825 (Miles et al)(e.g., the stack of sheets sold in a dispenser under the trade designation "Post-it"™ Tape Flags), but could also be adapted to dispense sheets of the types described in U.S. Pat. No. 5,086,946 (Blackwell et al). The content of those U.S. Pat. Nos. 4,907,825 and 4,907,825 are incorporated herein by reference.

The dispenser 20 comprises separable top and bottom portions 21 and 22 positionable in a closed position to define a cavity between the portions 21 and 22 adapted to receive the stack 10 of sheets 11. The bottom portion 22 of the dispenser 20 includes a bottom wall 24 having a support surface 25 that defines a bottom surface for the cavity. The top portion 21 of the dispenser 20 includes a top wall 26 spaced from the support surface 25 and having an inner top surface partially defining the cavity. The top portion 21 also has transverse, centered, spaced, closely adjacent outlet surfaces (e.g., spaced at about 0.178 centimeter or 0.070 inches) defining an outlet opening 28 for the cavity through the top wall 26. The top and bottom portions 21 and 22 also have side walls 30 defining side surfaces for the cavity extending between the top and bottom surfaces, which side walls 30 are separable to afford positioning the stack 10 of sheets within the cavity with an end portion 17 of the uppermost sheet 11 in the stack 10 projecting through the outlet opening 28 so that, after the dispenser 20 is closed, the uppermost sheet 11 in the stack 10 can be manually pulled through the outlet opening 28.

The top and bottom portions 21 and 22 also include means for releasably retaining the housing portions 21 and 22 in the closed position. As illustrated, that means comprises the bottom portion 22 including spaced elongate hooks 32 projecting generally normal to the support surface 25 and the top portion 21 having surfaces defining through openings 33 receiving the hooks 32. The hooks 32 and surfaces defining the openings 33 have attaching portions normally in engagement to attach the housing portions 21 and 22 together when the portions 21 and 22 are together with the hooks 32 projecting through the openings 33. Those attaching portions include projecting ledges 35 on the hooks 32, and ledges 36 on opposite sides of the openings 33. The hooks 32 are resiliently flexible in the openings 33 to afford separation of the attaching portions and thereafter separation of the housing portions 21 and 22. Alternatively, the hooks 32 could be on the top portion 21 and the openings 33 could be on the bottom portion 22. The top portion 21 of the dispenser 20 has through viewing openings 37 on opposite sides of the outlet opening 28 that both allow a user to see the number of sheets 11 remaining in the stack 10, and also allow a user to engage one finger with a surface defining one of the viewing openings 37 to provide a grip while using his or her thumb to flex the adjacent hook 32 toward it to disengage the hook 32 from the ledge 36 on the top portion 21 so that the dispenser 20 can be opened.

The surfaces defining the cavity between the top and bottom portions 21 and 22 are shaped to afford longitudinal reciprocating movement of the stack 10 of sheets 11 within that cavity in response to a force manually applied to the second end portion 17 of the uppermost sheet 11 in the stack 10 projecting through the opening 28 so that the uppermost sheet 11 in the stack 10 can be manually pulled through the opening 28 and will carry with it the second end portion 17 of the sheet 11 beneath it in the stack 10 to which the uppermost sheet 11 is adhered by a coating of adhesive, placing that second end portion 17 in a position where it also may be grasped and pulled to withdraw that sheet 11 from the stack 10. (see FIGS. 11 through 18 in U.S. Pat. No. 5,299,712, Carlson et al. for an illustration of how sheets are separated from the stack). The top portion 22 includes a pair of longitudinally extending parallel spaced ribs 38 with arcuate distal edges projecting generally normally from its top surface toward the bottom portion 22. The ribs 38 have central parts that are received in recesses in the bottom portion 22 flanking the support surface 25 to provide, together with short parallel spaced ribs 39 flanking the ends of the support surface 25 on the bottom portion 22, guidance for reciprocal movement of the stack 10 within the cavity so that it moves in directions parallel with the ribs 38 and 39 as sheets 11 are withdrawn from the dispenser 20.

Referring now to FIGS. 4, 5, and 6 of the drawing, there is shown a second embodiment of a dispenser according to the present invention generally designated by the reference numeral 40. The dispenser 40 can be used for dispensing flexible sheets 11 from a stack 10 of sheets of one of the types described above in the manner described in U.S. Pat. No. 5,518,144 issued May 21, 1996, (Samuelson et al. the content whereof is incorporated herein by reference).

The dispenser 40 comprises a separable top portion 41 and the bottom portion 22 described above that are positionable in a closed position to define a cavity between the portions 41 and 22 adapted to receive the stack 10 of sheets 11. The bottom portion 22 of the dispenser 40 includes the bottom wall 24 described above with reference to the dispenser 20 that has the support surface 25 that defines a bottom surface for the cavity. The top portion 41 of the dispenser 40 includes a top wall 43 spaced from the support surface 25 and having an inner top surface partially defining the cavity. The top portion 41 also has widely spaced outlet surfaces (e.g., spaced at about 2.4 centimeter or 0.94 inches) defining an outlet opening 44 for the cavity through the top wall 43. The outlet surfaces are partially defined by spaced ribs that also extend for a short distance along the outer surface of the top wall 43 and restrict adhesion of the sheets 11 to the top wall 43. The portions have side walls 45 and 30 defining side surfaces for the cavity extending between the top and bottom surfaces, which side walls are separable to afford positioning the stack 10 of sheets 11 within the cavity with the second end portion 17 of the uppermost sheet in the stack 10 projecting through the opening 44 so that, after the dispenser 40 is closed, the uppermost sheet 11 in the stack 10 can be manually pulled through the outlet opening 44.

The top and bottom portions 41 and 22 also include means for releasably retaining them in the closed position which, as illustrated, comprises the bottom portion 22 including the spaced elongate hooks 32 projecting generally normal to the support surface 25 and the top portion 43 having surfaces defining through openings 46 receiving the hooks 32, with the hooks 32 and surfaces defining the openings 46 having attaching portions of the types described above that can engage to attach the housing portions 41 and 22 together. The hooks 32 are resiliently flexible in the openings 46 to afford separation of the attaching portions and separation of the housing portions 41 and 22, and a user can engage one finger with one of the surfaces defining the outlet opening 44 to provide a grip while another finger is used to flex the adjacent hook 32 toward it to disengage it from the top portion 41 so that the dispenser 20 can be opened.

The bottom surface of the stack 10 of sheets 11 is fixed or adhered to the support surface 25 of the cavity so that, as is described in U.S. Pat. No. 5,518,144 (Samuelson et al), the uppermost sheet 11 in the stack 10 can be manually pulled through the outlet opening 44 and will carry with it the second end portion 17 of the sheet 11 beneath it in the stack 10 to which the uppermost sheet 11 is adhered by a coating of adhesive, placing that second end portion 17 in a position where it also may be grasped and pulled to withdraw that sheet 11 from the stack 10.

Figure 8:
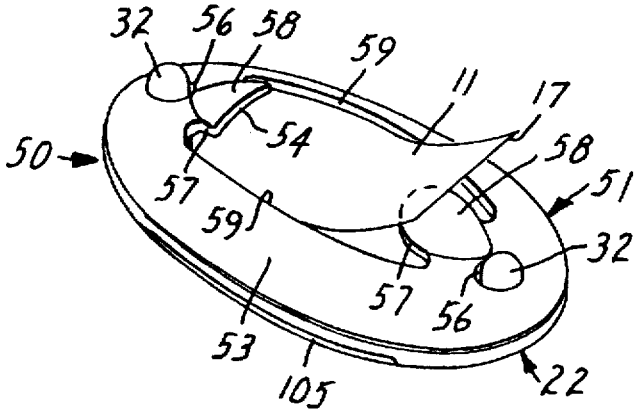
FIG. 8 is a perspective view of the dispenser of FIG. 7.
Figure 14:
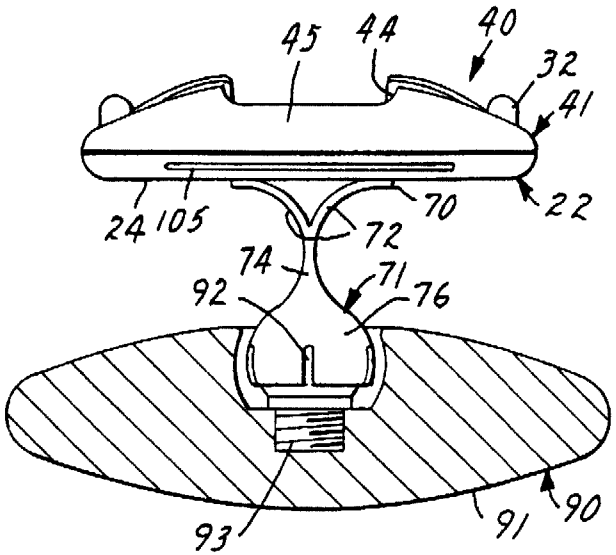
FIG. 14 is a side view of the dispenser of FIG. 4 attached by the support member of FIG. 10 to a third embodiment of a base included in the assembly according to the present invention, which base is sectioned to show detail.

Referring now to FIGS. 7 and 8 of the drawing, there is shown a third embodiment of a dispenser according to the present invention generally designated by the reference numeral 50. The dispenser 50 is similar to the dispenser 40 and can be used to dispense the same sheets dispensed by that dispenser in essentially the same way. The dispenser 50 comprises a separable top portion 51 and the bottom portion 22 described above that are positionable in a closed position to define a cavity between the portions 51 and 22 adapted to receive the stack 10 of sheets 11. The bottom portion 22 of the dispenser 40 includes the bottom wall 24 described above with reference to the dispenser 20 that has the support surface 25 that defines a bottom surface for the cavity. The top portion 51 of the dispenser 50 includes a top wall 53 spaced from the support surface 25 and having an inner top surface partially defining the cavity. The top portion 51 also has outlet surfaces including widely spaced outlet surfaces 57 (e.g., spaced at about 2.54 centimeters or 1 inch) defining an outlet opening 54 for the cavity through the top wall 53. The portions 51 and 22 have side walls defining side surfaces for the cavity extending between the top and bottom surfaces, which side walls are separable to afford positioning the stack 10 of sheets 11 within the cavity with the second end portion 17 of the uppermost sheet 11 in the stack projecting through the opening 54 so that, after the dispenser 50 is closed, the uppermost sheet 11 in the stack 10 can be manually pulled through the outlet opening 54. The housing portions 51 and 22 also include means for releasably retaining, them in the closed position which, as illustrated, comprises the base portion 22 including the spaced elongate hooks 32 projecting generally normal to the support surface 25 and the top portion 51 having surfaces defining through openings 56 receiving the hooks 32, with the hooks 32 and surfaces defining the openings 56 having attaching portions of the types described above in engagement to attach the housing portions 51 and 22 together. The hooks 32 are resiliently flexible in the openings 56 to afford separation of the attaching portions and separation of the housing portions 51 and 22, and a user can engage one finger with one of the surfaces defining the outlet opening 54 to provide a grip while his or her thumb is used to flex the adjacent hook 32 toward it to disengage it from the top portion 51 so that the dispenser 50 can be opened.

The bottom surface of the stack 10 of sheets 11 is fixed or adhered to the support surface 25 so that, as is described in U.S. Pat. No. 5,518,144 (Samuelson et al), the uppermost sheet 11 in the stack 10 can be manually pulled through the outlet opening 54 and will carry with it the second end portion 17 of the sheet 11 beneath it in the stack 10 to which the uppermost sheet 11 is adhered by a coating of adhesive, placing that second end portion 17 in a position where it also may be grasped and pulled to withdraw that sheet 11 from the stack 10.

The difference between the dispenser 50 and the dispenser 40 is in the shape of the outlet opening 54. Portions of the top wall 53 of the dispenser have outlet surfaces defining the outlet opening 54 including (1) opposed projecting portions 58 projecting towards each other from opposite ends of the top wall 53 and having the generally arcuate peripheral surfaces 57 partially defining the outlet opening 54, and side wall portions defining opposite side surfaces 59 partially defining the outlet opening and extending between corresponding sides of the projecting portions 58. The generally arcuate peripheral surfaces 57 on the projecting portions 58 extend for an arc that should be at least about 180 degrees around centers of the projecting portions 58, and, as illustrated, extend for an arc of about 240 degrees around centers of the projecting portions 58. Those arcuate peripheral surfaces 57 will make the majority of their contact with a sheet 11 at the center of the sheet 11 to limit contact between adhesive on the sheet 11 and the top wall 53 and will provide a user access to grasp the sheet 11 along its sides to pull the sheet 11 from the dispenser 50. This is particularly useful if the end portion 17 of the sheet 11 is somehow pushed back into the outlet opening 54 so that little of its end portion 17 projects above the top wall 53. While the outlet opening has sufficient width between the ends of the projecting portions 58 that allows free passage of the sheets 11, it has a width between the side surfaces 59 adjacent the distal ends of the projecting portions 58 that will engage the sides of the sheet when it is thus pushed into the dispenser 50 to restrict further movement of the end portion 17 of the sheet 11 back into the dispenser 50. The projecting portions 58 of the top wall 53 have inner surfaces that are cylindrically concave around axes in a common plane extending from the proximal ends to the distal ends of the projecting portions 58 (which common plane also includes the longitudinal axes of the dispenser 50) to provide structural strength for the projecting portions 58. The projecting portions 58 are tilted upwardly toward the center of the dispenser 50 (e.g., at an angle in the range of 15 to 45 degrees with respect to the support surface 25 and more preferably in the range of 20 to 30 degrees and as illustrated, 25 degrees with respect to the support surface 25) which, if the top sheet 11 contacts the top wall 53 as it is being dispensed, better directs forces in the top sheet 11 being dispensed to cause separation of the end of the second sheet 11 in the stack 10 from the third sheet 11 in the stack 10. The shape and positioning of the projecting portions 58 also provides good clearance for that separation during dispensing of the top sheet 11, which clearance is sufficient that dispensing forces applied to the sheets 11 in a direction generally at a right angle to the support surface 25 can cause such separation without contact of the sheet 11 being dispensed with the top wall 53. This precludes any possible marking of the sheets 11 by the top wall 53 as they are dispensed, and measurably reduces dispensing forces with respect to dispensers in which the sheets do contact the top wall of the dispenser as they are dispensed. Yet, the centers of the projecting portions 58 project sufficiently toward the center of the dispenser to insure that the end portion 17 of the sheet 11 beneath the sheet 11 being dispensed will be supported against one of the projecting portions 58 after the top sheet 11 is removed. If the end portion 17 of the sheet 11 is somehow pushed back into the outlet opening 54 so that little of its end portion 17 projects above the top wall 53 as described above, the side surfaces 59 will engage the sides of the sheet 11 to restrict further movement of the end portion 17 of the sheet 11 back into the dispenser 50 as described above, and the sheet 11 will curl causing its adhesive coated surface to slightly adhere to the curved inner surface of the projecting portions 58, which adherence further precludes movement of the sheet 11 back into the dispenser 50, while the edges of the sheet 11 are still engageable at the sides of its projecting portion to withdraw the sheet 11 from the dispenser 50.

Referring now to FIG. 9 of the drawing, there is shown a fourth embodiment of a dispenser according to the present invention generally designated by the reference numeral 60. The dispenser 60 can be used for dispensing flexible sheets from a stack 62 of sheets of the type sold under the trade designation "Post-it"™brand notes by Minnesota Mining and Manufacturing Company, St. Paul, Minn.

The dispenser 60 comprises a top portion 61 and the bottom portion 22 described above that are positionable in an attached or closed position. The top portion 61 includes a top wall 63 having an outer surface that includes a rectangular support surface 64 for the stack 62 of sheets. The bottom surface of the stack 62 of sheets is fixed or adhered to the support surface 64 on the top portion 61. The top portion 61 also includes walls having surfaces 65 projecting generally normal to that support surface 64 along three of its edges to protect edges of the stack 62 from inadvertent contact, while being free of projecting portions along one of its edges to afford access to the stack 62 so that the sheets in the stack 62 can be manually removed. The top and bottom portions 61 and 22 also include means for releasably retaining them in the attached position which, as illustrated, comprises the hooks 32 on the bottom portion 22 and the top portion 61 having surfaces defining through openings 67 receiving, the hooks 32, with the hooks 32 and surfaces defining the openings 67 having attaching portions in engagement to attach the housing portions 61 and 22 together. The hooks 32 are resiliently flexible in the openings 67 to afford separation of the attaching portions and separation of the housing portions 22 and 61 in the manner described above. A user can engage one finger with one of the wall surfaces 65 to provide a grip while his or her thumb is used to flex the adjacent hook 32 to disengage it from the top portion 61 so that the dispenser 60 can be opened. Opening the dispenser 60 allows the bottom portion 22 to be used with one of the other top portions 21, 41 or 51 described above.

Each of the dispensers 20, 40, 50 and 60 includes attaching means adapted for releasably attaching it to several different retaining means for releasably retaining the dispenser 20, 40, 50 or 60 at a predetermined location. These attaching means comprise the bottom portion 22 of having two transversely extending openings 68 partially defined by lip like portions 69 of the bottom wall 24 extending toward the opposite ends of the bottom portion 22 on opposite sides of its center. The lip-like portions 69 are adapted to be engaged by opposed hook-like distal end portions 70 of a support member 71 (see FIGS. 10, 11, 13, and 14) extending through the openings 68, which hook like distal end portions 70 provide means for releasably attaching the support member 71 to the bottom wall 24 of the bottom portion 22. The support member 71 is adapted to be engaged by a user's fingers and has finger engagement surfaces 72 that face in opposite directions on opposite sides of the support member 71. The finger engagement surfaces 72 on the support member 71 are shaped to engage adjacent side surfaces of a user's fingers, and the support member 71 includes a narrow web like portion 74 between the finger engagement surfaces 72 adapted to comfortably extend between the fingers of a user positioned along the finger engagement surfaces 72. Also, the support member 71 includes a semi spherical retainer portion 76 wider than the web like portion 74 that is adapted to be positioned along the inner surfaces of a user's fingers. As illustrated, the finger engagement surfaces 72 that face in opposite directions on opposite sides of the support member 71 are arcuate around parallel axes so that they can fit closely along the surface of the fingers, however, the finger engagement surfaces 72 could have other contours that contact the side surfaces of the fingers only in spaced locations. Also as illustrated, the retainer portion 76 that is significantly wider than the web like portion 74 and is adapted to be positioned along the inner surface of a user's fingers is generally semi-spherical. The retainer portion 76 has parts including spaced projecting parts around its distal end that define a socket opening through the side of the retainer portion 76 opposite the web like portion 74.

The assembly can further include a weighted base such as one of the weighted bases 80, 85 and 90 illustrated in FIGS. 11 through 14. Each of those bases 80, 85 and 90 has an arcuate bottom surface 81, 86 and 91 respectively that is adapted to be supported on a planar horizontal surface, and has a spherical portion 82, 87 and 92 respectively centered in a recess at the top end of the base 80, 85, and 90 opposite its arcuate bottom surface 81, 86, and 91 that can be removably received in the socket in the spherical portion 76 of the support member 71 with its projecting parts frictionally and releasably engaging the spherical portion 81, 86 or 91. Each of the bases 80, 85 or 90 has sufficient weight (e.g., at least 300 grams and preferably over 600 grams) so that sheets can be removed from the dispensers 20, 40, 50 or 60 attached to the base 80, 85, or 92 with one hand. The support member 71 is easily removable from any of the bases 80, 85 or 90 by pulling it off of the spherical portion 82, 87 or 92 so that it can be positioned between a user's fingers to support the dispenser 20, 40, 50 or 60 along the back surface of the user's fingers.

The bases 80, 85, and 90, and particularly the base 80, raises the dispenser 20, 40, 50 or 60 above other items on a surface on which the base is supported (i.e., above the papers and other items on a desk top) to bring attention to a dispenser 20, 40, 50, or 60 supported on it and so that it can be easily found. The arcuate bottom surface 81, 86 or 91 allows the base 80, 85 or 90 to rock on a planar surface supporting it (e.g., a desk top) which is a source of amusement and can further draw attention to the dispenser, and (together with pivoting, of the retainer portion 76 on the spherical portion 82, 87 or 92) allows the dispenser 20, 40, 50, or 60 to generally align with the direction of the force being applied to remove the sheet 11 or 61, and thereby facilitates appropriate dispensing of sheets. The arcuate bottom surface 81, 86 or 91 is a spherical surface portion having a radius in the range of about 5 to 15 centimeters or 2 to 6 inches, and preferably has a radius in the range of about 7.6 to 12.7 centimeters or 3 to 5 inches (e.g., 10.2 centimeters or 4 inches). The height of the base 80, 85 or 90 between its bottom surface 81, 86 or 91 and the center of the spherical portion 82, 87 or 92 can be greater than the diameter of the bottom surface 81 or 86 as is illustrated by the bases 80 and 85 in FIGS. 11, 12 and 13, or can be less than the diameter of the bottom surface 91 as is illustrated by the base 92 in FIG. 14. The bases 80, 85 and 90 illustrated can have major portions thereof machined of solid steel and can be chrome plated, with the spherical portion 82, 87 or 92 being a black zinc coated steel screw machine part with a threaded base 83, 88 or 93 that is screwed into a socket in the major portion. Alternatively, bases with the same shapes could be molded of polymeric material in three pieces, one forming a bottom part and another a top part with those portions being joined at a horizontal seam and having inner surfaces defining a cavity therebetween. That cavity could be filled with steel shot through a top central opening in the top part, and the third piece could include the spherical portion and a base that is inserted and fastened in the that central opening after the shot is in the cavity by adhesive or mechanical engagement with the top part.

Figure 12:
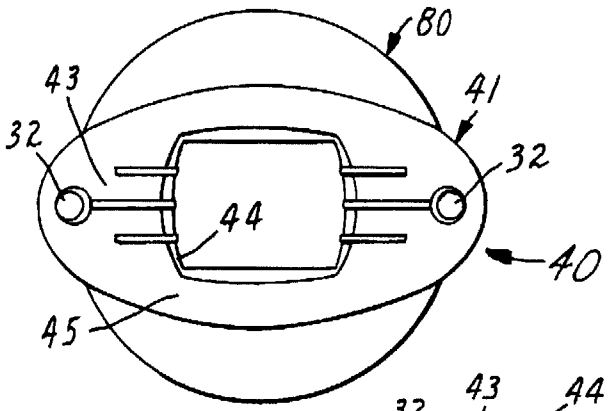
FIG. 12 is a top view of the structures illustrated in FIG. 11.
Figure 13:
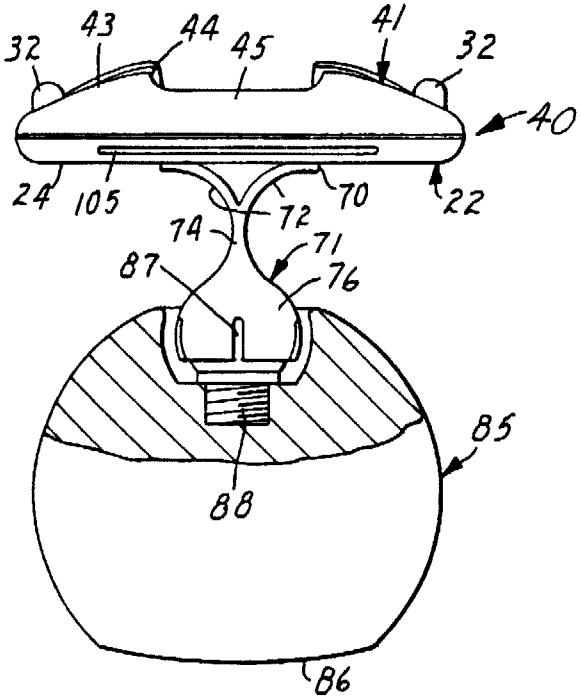
FIG. 13 is a side view of the dispenser of FIG. 4 attached by the support member of FIG. 10 to a second embodiment of a base included in the assembly according to the present invention, which base has a part broken away and sectioned to show detail.

As an example, the base 80 illustrated in FIGS. 11 and 12 can have a maximum diameter of 5.7 centimeters or 2.25 inches, a bottom surface 81 radius of 10.2 centimeters or 4 inches, a height from the bottom surface to the center of the spherical portion 82 of 5.77 centimeters or 2.27 inches and a weight of about 1,011.6 grams or 2.23 pounds. The base 85 illustrated in FIG. 13 can have a maximum diameter of 6.2 centimeters or 2.44 inches, a bottom surface 86 radius of 10.2 centimeters or 4 inches, a height from the bottom surface 86 to the center of the spherical portion 87 of 4.91 centimeters or 1.93 inches and a weight of about 952.6 grams or 2.1 pounds. The base 90 illustrated in FIG. 14 can have a maximum diameter of 8.89 centimeters or 3.5 inches, a bottom surface 91 radius of 10.2 centimeters or 4 inches, a height from the bottom surface 91 to the center of the spherical portion 92 of 2.24 centimeters or 0.88 inch and a weight of about 884.5 grams or 1.95 pounds. With these specifications which provide a higher center of gravity for the base 80 than for the base 90, the base 90 rocks more easily than the base 80 when the same dispensing or other external force is applied to those bases, however the rocking motion of the base 90 stops or damps out more quickly than the rocking, motion of the base 80.

Figure 15:
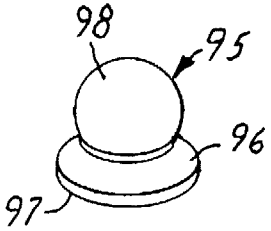
FIG. 15 is an perspective view of a non-weighted mountable pedestal included in the assembly according to the present invention.

The assembly can also include a non weighted mountable pedestal 95 illustrated in FIG. 15 including a generally conical base portion 96 having a circular bottom surface 97 adapted to be attached to a substrate (e.g., by adhesive, a magnet or a suction cup), and a spherical portion 98 attached to the apex of the base portion 96 and adapted to be removably received in the socket in the retaining portion 76 of the support member 71 with its projecting parts frictionally and releasably engaging the spherical portion 98. The bottom surface 97 of the pedestal 95 can be attached to a surface and used to support the support member 71 at times when the user does not choose to support it between his fingers, and provides an anchor for the support member 71 so that sheets 11 can be removed from the dispenser 20 with one hand when the support member 71 is engaged with the pedestal 95. The support member 71 can always be easily removed from the pedestal 95 by pulling its retaining portion 76 off of the spherical portion 98 so that it can again be positioned between a user's fingers to support the dispenser 20, 40, 50, or 60 along the back surface of the user's fingers.

Figure 16:
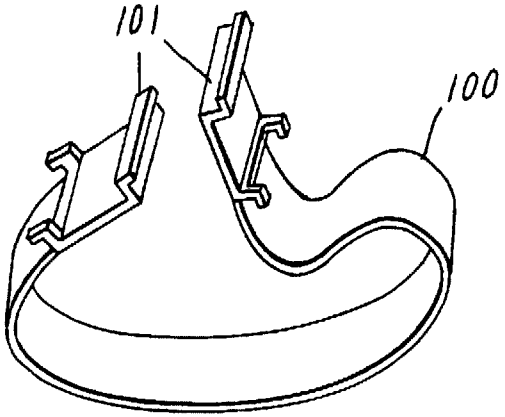
FIG. 16 is an perspective view of an elastic strap included in the assembly according to the present invention.
Figure 17:
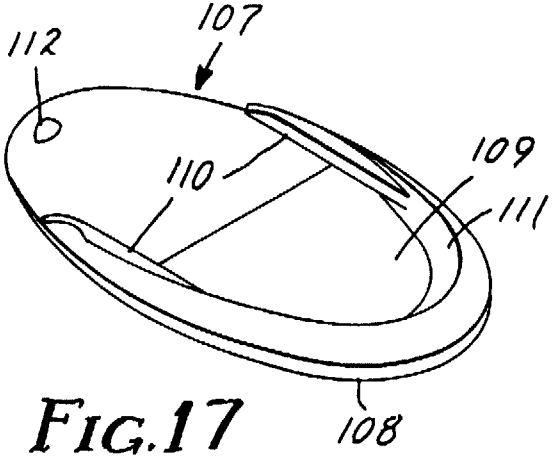
FIG. 17 is an perspective view of an un weighted mountable base included in the assembly according to the present invention.
Figure 21:
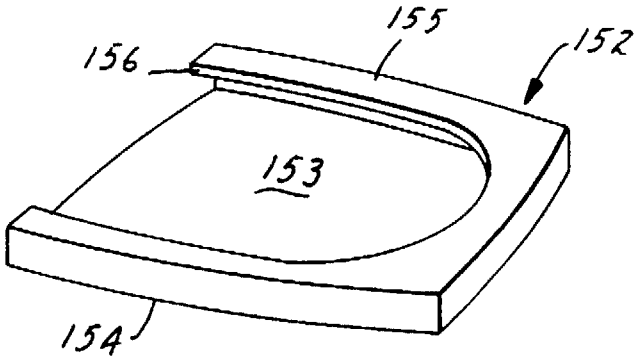
FIG. 21 is an perspective view of a mounting bracket included in the assembly according to the present invention that is adapted to receive the dispenser of FIG. 20.

As illustrated in FIG. 16, the assembly further includes a resiliently elastic strap 100 having hook-like members 101 fixed or molded to its opposite ends that are adapted to engage the bottom wall 24 of the dispenser 20, 40, 50, or 60 at the openings 68 when that dispenser is separated from the support member 71 to afford supporting the dispenser 20, 40, 50 or 60 on a users hand with the strap 100 extending around the side of the users hand opposite the dispenser 20, 40, 50, or 60.

The attaching means included in the assembly also comprises the bottom portion 22 of the dispensers 20, 40, 50, and 60 having parallel longitudinal grooves 105 generally parallel to the support surface 25 along opposite sides. Those grooves 105 afford attachment of the dispensers 20, 40, 50, and 60 to an un-weighted mountable base 107 illustrated in FIG. 17. The base 107 has a planar attachment surface 108 adapted to be attached to a substrate, and has a recess 109 along the side of the base 107 opposite the attachment surface 108. The base 107 includes opposed ridges 110 projecting into the recess 109 and adapted to be engaged in the grooves 105 in the bottom portion 22 by sliding the bottom portion 22 over ridges 110. A transverse surface 111 on the base 107 extending between corresponding ends of the ridges 110 is adapted to be engaged by the bottom portion 22 slid over the ridges 110 to define full engagement of the dispenser 20, 40, 50, or 60 with the base 107, and detent means are provided for releasably retaining that dispenser in its fully engaged position. The detent means include a projection 112 sized for slight interference with the bottom surface of the bottom wall 24, and to releasably engage openings 113 through the bottom wall 24 that are present adjacent the base of the hooks 32 to facilitate molding the heads on the hooks 32. As illustrated, the projection 112 is at the end of the base 107 opposite the surface 111, however, alternatively, it could be positioned at the end of the base 107 adjacent the surface 111.

The planar attachment surface 108 of the base 107 can be attached to a horizontal or vertical surface so that one of the sheets 11 or 61 can be withdrawn from one of the dispensers 20, 40, 50, or 60 engaged in the base with one hand. Such attachment can be achieved by means (not shown) such as a length of stretch release tape of the type described in U.S. Pat. No. 5,516,581, issued May 14, 1996, the content whereof is incorporated herein by reference), a length of foam tape coated with pressure sensitive adhesive on both sides, a suction cup, or a sheet of flexible material attached at its center to the center of the surface 108 in the manner described in U.S. Pat. No. 5,014,946, which flexible material then momentarily acts like a suction cup against a surface on which the un-weighted mountable base 107 is supported when a sheet 11 or 61 is withdrawn from the dispenser 20, 40, 50, or 60.

Figure 18:
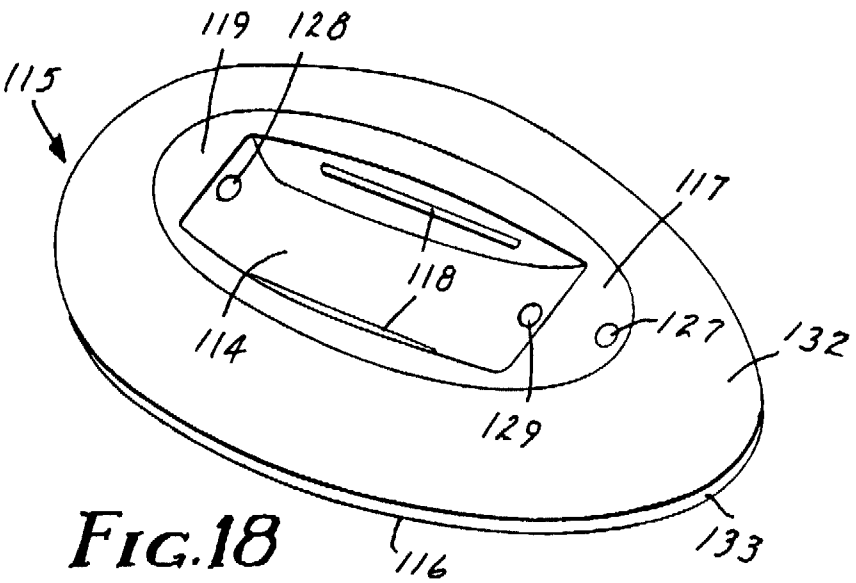
FIG. 18 is an perspective view of a weighted heavy base included in the assembly according to the present invention.

The grooves 105 in the bottom portion 22 also afford attachment of any one of the dispensers 20, 40, 50, or 60 to a heavy weighted base 115 illustrated in FIG. 18 that has a planar bottom surface 116 adapted to be supported on a generally horizontal substrate. The base 115, like the base 107, has a recess 117 along the side of the base 115 opposite the bottom surface 116. Also like the base 107, the base 115 includes ridges 118 adapted to be engaged in the grooves 105 in the bottom portion 22 by sliding the dispenser 20, 40, 50, or 60 over the ridges 118, a transverse surface 119 on the base 115 extending between corresponding ends of the ridges 118 adapted to be engaged by the dispenser 20, 40, 50, or 60 slid over the ridges 118 to define full engagement of that dispenser with the base 115, and the same type of detent means described above including a projection 127 adapted to releasably engage the openings 113 for releasably retaining that dispenser in its fully engaged position.

Figure 19:
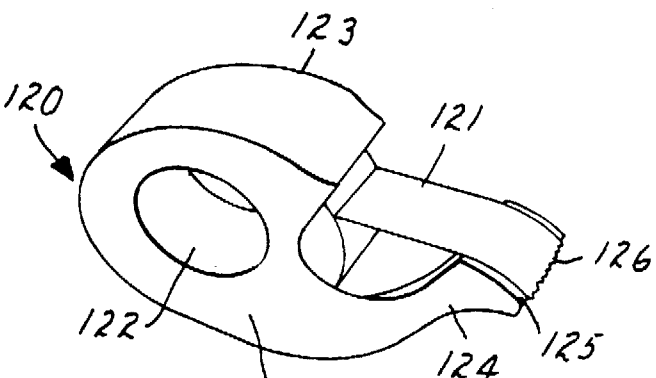
FIG. 19 is an perspective view of a roll tape dispenser included in the assembly according to the present invention.

The weighted base 115 also has a socket 114 centered on the recess 117 that is adapted to receive a light weight roll tape dispenser 120 illustrated in FIG. 19. The dispenser 120 dispenses tape 121 from a roll of the tape 121 and, like a conventional un-weighted or light weight roll tape dispenser, includes a hub 122 on which the roll of tape 121 is rotatably supported between molded side walls 123 of the dispenser 120, and a pedestal 124 defined by the side walls 123 having a land surface 125 on its upper end on which an end of the tape 121 can be adhered, and a serrated cutting blade 126 at the edge of the land surface 125 opposite the hub 122 which can be used to cut a length of tape 121 pulled form the roll. Conventionally, the dispenser 120 is also shaped so that a person can position his or her finger under the tape 121 extending between the hub 122 and the pedestal 124 so that the tape 121 can be grasped and then withdrawn from the dispenser 120. The dispenser 120 differs from known un-weighted dispensers in that a portion of its housing is shaped to releasably engage the surfaces defining the socket 114 in the weighted base 115 so that the light weight dispenser 120 can either be removed from the base 115 and used to dispense tape 121 which then typically requires two hands, or can be releasably engaged with the heavy base 115 so that tape 121 can be withdrawn from the tape roll in the dispenser 120 with only one hand. The engagement of the dispenser 120 in the weighted base 115 is provided by a pair of opposed projections 128 and 129 on opposite sides of the socket 114 which are adapted to releasably engage a pair of openings along the side walls of the housing for the dispenser 120 to releasably hold the dispenser 120 in the socket 114.

The weighted base 115 for use with the dispensers 20, 40, 50, 60, or 120 has sufficient weight (e.g., at least 425 grams or 0.49 pound) that one of the sheets 11 or 61 or the tape 121 can be withdrawn from the dispenser with one hand without moving the dispenser attached to the weighted base 115. The weighted base 115 includes two portions 132 and 133 having peripheries engaged and sealed together (e.g., by glue or heat fusion such as by sonic welding) to define a chamber filled with ballast such as lead or steel shot or sand.

Figure 20:
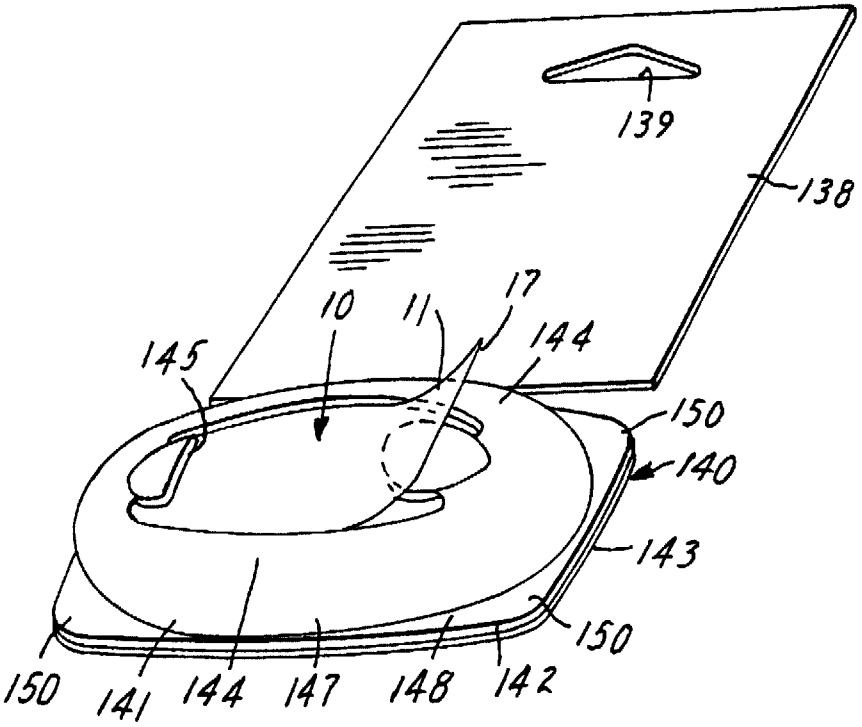
FIG. 20 is an perspective view of a fifth embodiment of a dispenser and a stack of sheets included in the assembly according to the present invention.

FIG. 20 illustrates yet another embodiment of an assembly according to the present invention that comprises a stack 10 of flexible sheets 11 of the type described above and a dispenser 140 that could be intended to only dispense that one stack 10 of sheets 11. The dispenser 140 comprises top and bottom portions 141 and 142 defining a cavity between the portions in which the stack 10 of sheets is positioned. The bottom portion 142 comprises a planar generally rectangular pasteboard bottom wall 143 having a support surface defining a bottom surface for the cavity. The bottom wall 143 is attached at a line of perforations to a rectangular support panel 138 on which can be printed information and advertising concerning the dispenser 140 and which has an opening 139 by which the dispenser 140 can be hung from a peg, such as in a store where it is being sold. The top portion 141 includes a an arcuate top wall 144 spaced from the bottom surface that has an inner top surface partially defining the cavity and has spaced adjacent outlet surfaces defining an outlet opening 145 for the cavity through the top wall 144. The top portion 142 also includes a generally oval side wall 147 defining side surfaces for the cavity extending between the top surface portions and the bottom surface, and a flange 148 with a generally rectangular periphery having the same dimensions as the periphery of the bottom wall 143 projecting outwardly from the edge of the side wall 147 opposite the top wall 144. The flange 148 is fixed surface to surface to the bottom wall 143 to retain the stack 10 of sheets 11 within the cavity with the uppermost sheet in the stack projecting through the opening 145 so that the uppermost sheet 11 in the stack 10 can be manually pulled through the opening 145. The dispenser 140 then has four corner portions 150 projecting beyond the side wall 147. The assembly further includes a mounting bracket 152 including a rear wall 153 having a planar attachment surface 154 adapted to be attached to a planar substrate, and a front wall 155 attached to and spaced from the side of the rear wall 153 opposite the attachment surface by edge walls. The opposed surfaces of the front and rear walls 155 and 153 define a socket adapted to closely receive two of the corner portions 150 of the bottom wall 141 and parts of the other two corner portions 150 after the support panel 138 is torn away, and the front wall 155 has a through opening 156 in which the top portion 141 of the housing is then positioned so that the outlet opening 145 is accessible along its top portion 141. The planar mounting surface 154 of the mounting bracket 152 can be attached to a horizontal or vertical surface by any of the means described above with respect to the un-weighted mountable base 107 so that one of the sheets 11 can be withdrawn from the dispenser 140 engaged in the mounting bracket 152 with one hand. The dispenser 140 is removable from the mounting bracket 152 by sliding its corner portions 150 out of the socket.

The bottom wall 143 of the dispenser 140 can have perforations defining removable portions of the bottom wall 143 that, when removed, provide openings similar to the two transversely extending openings 68 in the bottom wall 24 of the bottom portion 22 described above so that the bottom wall 143 can be engaged through those openings by the hook like distal end portions 70 of the support member 71 described above with respect to FIG. 10. Thus, that support member 71 could be used to support the dispenser along the back surface of a users fingers, or on one of the bases 80, 85 or 90 described above with respect to FIGS. 11 through 14, or on the mountable pedestal 95 described above with reference to FIG. 15.

Figure 22:
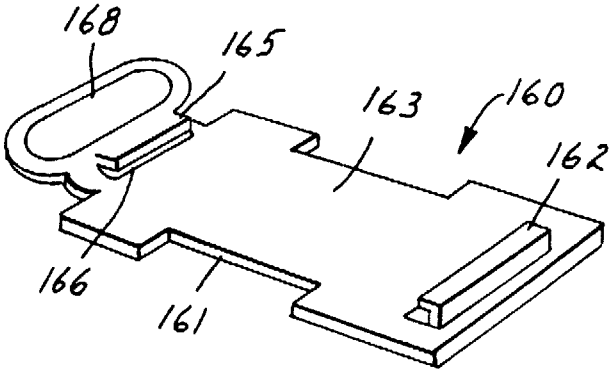
FIG. 22 is an perspective view of an attachment bracket that can be used to releasably attach the dispenser of FIG. 20 to a substrate.

The dispenser 140 may also be releasably engaged with a bracket 160 illustrated in FIG. 22 which is further described in U.S. patent application No. 08/306,102 filed Sept. 14, 1994. That bracket 160 can have its rear surface 161 adhered or otherwise attached to a substrate. The bracket 160 includes a ridge 162 projecting above its front surface 163 and defining a recess adapted to receive one end of the bottom portion 142, and a latch portion 165 spaced along its front surface 163 from the ridge 162 and having a recess 166 adapted to receive the other end of the bottom portion 142. A projection 168 on the bracket 160 can be manually resiliently deflected with respect to the surface 163 to afford engaging or disengaging the end of the bottom portion 142 with the recess 166.

The present invention has now been described with reference to several embodiments thereof. It will be apparent to those skilled in the art that many changes or additions can be made in the embodiments described without departing from the scope of the present invention. Thus, the scope of the present invention should not be limited to the structures described in this application, but only by structures described by the language of the claims and the equivalents of those structures.

What is claimed is:

1. An assembly comprising:

a dispenser for flexible sheets from a stack of sheets disposed one on top of another, said dispenser having a support surface adapted for supporting the stack of sheets and including a bottom wall;

a support member including attaching means for releasably attaching said support member to the side of said bottom wall opposite said support surface, retainer portion having a socket opening through the side of the retainer portion opposite the web like portion; and a weighted base having an arcuate bottom surface adapted to be supported on a generally horizontal surface, and a spherical portion on the side of the base opposite the arcuate bottom surface removably received in the socket with said retainer portion frictionally and releasably engaging the spherical portion, said base having sufficient weight so that the sheets can be removed from the dispenser with one hand, said retainer portion being easily removable from the base by pulling it off of the spherical portion so that it can be positioned between a user's fingers to support the dispenser along the back surface of the user's hand.

2. An assembly according to claim 1 wherein said dispenser further comprises top and bottom portions positionable in a closed position defining a cavity between said portions adapted to receive the stack of sheets, said bottom portion including a bottom wall having said support surface that defines a bottom surface for said cavity, said top portion including a top wall spaced from said bottom surface and having an inner top surface partially defining said cavity, and having spaced adjacent outlet surfaces defining an outlet opening for said cavity through said top wall, said portions having side walls defining side surfaces for said cavity extending between said top surface portions and said bottom surface and being separable to afford positioning the stack of sheets within the cavity and dispensing of the uppermost sheet in the stack projecting through the opening so that the uppermost sheets in the stack can be manually pulled through the opening, and means for releasably retaining said housing portions in said closed position.

3. An assembly according to claim 2 wherein said means for releasably retaining said housing portions in said closed position comprises one of said portions including spaced elongate projecting hooks and the other of said portions having surfaces defining through openings receiving said hooks, said hooks and surfaces defining said openings having attaching portions in engagement to attach said housing portions together and said hooks being resiliently flexible in said openings to afford separation of said attaching portions and separation of said housing portions.

4. An assembly according to claim 1 wherein said dispenser has an outer surface including a portion defining said support surface, said support surface has four rectangularly disposed edges, said dispenser includes walls having surfaces projecting generally normal to said support surface along three of said edges and is free of projecting portions along one of said edges to afford access to said stack of sheets on said support surface so that the sheets in the stack can be manually removed.

5. An assembly according to claim 1 wherein said bottom wall has two spaced transversely extending openings, and said support member has opposed hook-like distal end portions extending through said openings to provide said attaching means for releasably attaching the support member to the side of said bottom wall opposite said support surface.

6. An assembly according to claim 5 further including a resiliently elastic strap having opposite ends and hook-like members fixed to said opposite ends of said strap adapted to engage said bottom wall at said openings when said dispenser is separated from said support member to afford supporting said dispenser on a users hand with said strap extending around the side of the users hand opposite said dispenser.

7. An assembly according to claim 1 wherein said base has a weight of at least 300 grams, and said arcuate bottom surface has a radius in the range of about 5 to 15 centimeters or about 2 to 6 inches.

8. An assembly according to claim 1 wherein said base has a weight of at least 600 grams, and said arcuate bottom surface has a radius in the range of about 7.6 to 12.7 centimeters or about 3 to 5 inches.

9. An assembly according to claim 1 wherein said base has a weight of at least 600 grams, said arcuate bottom surface has a radius in the range of about 7.6 to 12.7 centimeters or 3 to 5 inches, and the height of said base between said bottom surface and the center of said spherical portion is in the range of about 1.8 to 6.4 centimeters or 0.7 to 2.5 inches.

10. An assembly according to claim 1 wherein said support member has finger engagement surfaces that face in opposite directions on opposite sides of the support member shaped to engage adjacent side surfaces of a user's fingers and includes a narrow web like portion between the finger engagement surfaces adapted to comfortably extend between the fingers of a user positioned along the finger engagement surfaces, said retainer portion being wider than the web like portion and being adapted to be positioned along the inner surfaces of a user's fingers.

11. An assembly comprising a dispenser for flexible sheets from a stack of sheets disposed one on top of another, said dispenser comprising top and bottom portions in a closed position to define a cavity between said portions adapted to receive the stack of sheets, said bottom portion including a bottom wall having a support surface defining a bottom surface for said cavity, said top portion including a top wall spaced from said bottom surface and having an inner top surface partially defining said cavity, and having spaced adjacent outlet surfaces defining an outlet opening for said cavity through said top wall, said portions having side walls defining side surfaces for said cavity extending between said top surface portions and said bottom surface and being separable to afford positioning the stack of sheets within the cavity with the uppermost sheet in the stack projecting through the opening so that the uppermost sheets in the stack can be manually pulled through the opening, and means for releasably retaining said housing portions in said closed position comprising, one of said portions including spaced elongate projecting hooks and the other of said portions having surfaces defining through openings receiving said hooks, said hooks and surfaces defining said openings having attaching portions in engagement to attach said housing portions together and said hooks being resiliently flexible in said openings to afford separation of said attaching portions and separation of said housing portions.

12. An assembly according to claim 11 wherein said bottom wall has two spaced transversely extending openings and said dispenser has parallel longitudinal grooves generally parallel to said support surface along opposite sides, and said assembly further includes a support structure selected from the group consisting essentially of:

a support member having opposed hook-like distal end portions adapted to extend through said openings and engage said bottom wall to provide means for releasably attaching the support member to the side of said bottom wall opposite said support surface, said support member having finger engagement surfaces that face in opposite directions on opposite sides of the support member shaped to engage adjacent side surfaces of a user's fingers and that include a narrow web like portion between the finger engagement surfaces adapted to comfortably extend between the fingers of a user positioned along the finger engagement surfaces, and including a retainer portion wider than the web like portion adapted to be positioned along the inner surfaces of a user's fingers;

a resiliently elastic strap having opposite ends and hook-like members fixed to said opposite ends of said hooks adapted to extend through said openings and engage said bottom wall to afford supporting said dispenser on a users hand with said strap extending around the side of the users hand opposite said dispenser;

an un-weighted mountable base having a planar attachment surface adapted to be attached to a substrate, and surfaces defining a recess along the side of the base opposite said attachment surface, said un-weighted mountable base including opposed ridges projecting into said recess and adapted to be engaged in the grooves in said dispenser by sliding the dispenser over said ridges, and having a transverse surface extending between corresponding ends of said ridges adapted to be engaged by the dispenser slid over said ridges to define full engagement of said dispenser with said un-weighted mountable base; and a weighted base having a planar bottom surface adapted to be supported on a horizontal substrate, and surfaces defining a recess along the side of the base opposite said bottom surface, said weighted base including opposed ridges projecting into said recess and adapted to be engaged in the grooves in said dispenser by sliding the dispenser over said ridges, and having a transverse surface extending between corresponding ends of said ridges adapted to be engaged by the dispenser slid over said ridges to define full engagement of said dispenser with said weighted base.

13. An assembly according to claim 11 wherein said bottom wall has two spaced transversely extending openings and said dispenser has parallel longitudinal grooves generally parallel to said support surface along opposite sides, and said assembly further includes:

a support member having opposed hook-like distal end portions adapted to extending through said openings and engage said bottom wall to provide means for releasably attaching the support member to the side of said bottom wall opposite said support surface, said support member having finger engagement surfaces that face in opposite directions on opposite sides of the support member shaped to engage adjacent side surfaces of a user's fingers and that include a narrow web like portion between the finger engagement surfaces adapted to comfortably extend between the fingers of a user positioned along the finger engagement surfaces, and including a retainer portion wider than the web like portion adapted to be positioned along the inner surfaces of a user's fingers, said retainer portion defining a socket opening through the side of the retainer portion opposite the web like portion;

a weighted base having an arcuate bottom surface adapted to be supported on a horizontal surface, and a spherical portion on the side of the base opposite the arcuate bottom surface removably received in the socket with said retaining portion frictionally and releasably engaging the spherical portion, said base having sufficient weight so that the sheets can be removed from the dispenser with one hand, said retainer portion being easily removable from the base by pulling it off of the spherical portion so that it can be positioned between a user's fingers to support the dispenser along the back surface of the user's hand;

a resiliently elastic strap having opposite ends and hook-like members fixed to said opposite ends of said hooks adapted to extend through said openings and engage said bottom wall to afford supporting said dispenser on a users hand with said strap extending around the side of the users hand opposite said dispenser; and an un-weighted mountable base having a planar attachment surface adapted to be attached to a substrate, and surfaces defining a recess along the side of the base opposite said attachment surface, said un-weighted mountable base including opposed ridges projecting into said recess and adapted to be engaged in the grooves in said dispenser by sliding the dispenser over said ridges, and having a transverse surface extending between corresponding ends of said ridges adapted to be engaged by the dispenser slid over said ridges to define full engagement of said dispenser with said un-weighted mountable base; and a weighted base having a planar bottom surface adapted to be supported on a horizontal substrate, and surfaces defining a recess along the side of the base opposite said bottom surface, said weighted base including opposed ridges projecting into said recess and adapted to be engaged in the grooves in said dispenser by sliding the dispenser over said ridges, and having a transverse surface extending between corresponding ends of said ridges adapted to be engaged by the dispenser slid over said ridges to define full engagement of said dispenser with said weighted base.

14. An assembly comprising a dispenser and a stack of flexible sheets disposed one on top of another, said dispenser comprising top and bottom portions defining, a cavity between said portions in which the stack of sheets is positioned, said bottom portion comprising a planar rectangular bottom wall having four corners and a support surface defining a bottom surface for said cavity, said top portion including a an arcuate top wall spaced from said bottom surface, having an inner top surface partially defining said cavity, and having spaced adjacent outlet surfaces defining an outlet opening for said cavity through said top wall, said top portion including a generally oval side wall defining side surfaces for said cavity extending between said top surface portions and said bottom surface and a flange projecting outwardly from the edge of the side wall opposite said top wall, said flange being fixed to said bottom wall to retain the stack of sheets within the cavity with the uppermost sheet in the stack projecting through the opening so that the uppermost sheets in the stack can be manually pulled through the opening, said dispenser having, corner portions adjacent said corners projecting beyond said side wall; and a mounting bracket including a rear wall having a planar attachment surface adapted to be attached to a planar substrate, a front wall spaced from the side of said rear wall opposite said attachment surface with opposed surfaces of said walls defining a socket closely receiving at least two of said corner portions, said front wall having a through opening in which said top portion is positioned so that said outlet opening is accessible along said top portion, said dispenser being removable from said mounting bracket by sliding said corner portions out of said socket.

15. A dispenser for flexible sheets from a stack of sheets disposed one on top of another, said dispenser comprising top and bottom housing portions in a closed position to define a cavity between said portions adapted to receive the stack of sheets, said bottom housing portion including a bottom wall having a support surface defining a bottom surface for said cavity, said top housing portion including a top wall spaced from said bottom surface, having an inner top surface partially defining said cavity, having opposite ends, and having top wall portions with outlet surfaces defining an outlet opening for said cavity through said top wall to afford positioning the stack of sheets within the cavity with the uppermost sheet in the stack projecting through the opening adjacent one of said ends so that the uppermost sheets in the stack can be manually pulled through the opening, said top wall portions including opposed projecting portions projecting towards each other from said opposite ends of the top wall and having generally arcuate peripheral surfaces partially defining said opening, and side wall portions defining opposite side surfaces partially defining said opening and extending between corresponding sides of said projecting portions, said projecting portions being adapted to support said sheets at the centers of said sheets and to afford access to opposite edges of said sheets to facilitate withdrawing said sheets from said dispenser.

16. A dispenser according to claim 15 wherein said opposed projecting portions have proximal and distal ends and define parts of said inner top surface increasing in distance from said support surface from said proximal ends toward said distal ends of said projecting portions.

17. A dispenser according to claim 16 wherein said parts of said inner top surface on said projecting portions are disposed in the range of about 15 to 45 degrees with respect to said support surface.

18. A dispenser according to claim 16 wherein said parts of said inner top surface on said projecting portions are cylindrically arcuate about axes in a common plane extending from said proximal ends to said distal ends of said projecting portions.

19. A dispenser according to claim 16 wherein said generally arcuate peripheral surfaces on said projecting portions extend for an arc of at least about 180 degrees around centers of said projecting portions.

20. A dispenser according to claim 16 wherein said generally arcuate peripheral surfaces on said projecting portions extend for an arc of at least about 240 degrees around centers of said projecting portions.

21. A dispenser according to claim 16 wherein the sheets have a predetermined width dimension and wherein said side surfaces on said side wall portions are spaced at distances slightly less than said width dimension adjacent the distal ends of said projecting portions.

22. A dispenser according to claim 16 wherein said top and bottom housing portions are separable to afford positioning the stack of sheets within the cavity, and said dispenser includes means for releasably retaining said housing portions in said closed position comprising one of said housing portions including spaced elongate projecting hooks and the other of said housing portions having surfaces defining through openings receiving said hooks, said hooks and surfaces defining said openings having attaching portions in engagement to attach said housing portions together and said hooks being resiliently flexible in said openings to afford separation of said attaching portions and separation of said housing portions.

23. A dispenser according to claim 16 wherein said bottom wall has two spaced transversely extending openings and said dispenser has parallel longitudinal grooves generally parallel to said support surface along opposite sides, and said dispenser is included in an assembly further including a support structure selected from the group consisting essentially of:

a support member having opposed hook-like distal end portions adapted to extend through said openings and engage said bottom wall to provide means for releasably attaching the support member to the side of said bottom wall opposite said support surface, said support member having finger engagement surfaces that face in opposite directions on opposite sides of the support member shaped to engage adjacent side surfaces of a user's fingers and that include a narrow web like portion between the finger engagement surfaces adapted to comfortably extend between the fingers of a user positioned along the finger engagement surfaces, and including a retainer portion wider than the web like portion adapted to be positioned along the inner surfaces of a user's fingers;

a resiliently elastic strap having opposite ends and hook-like members fixed to said opposite ends of said hooks adapted to extend through said openings and engage said bottom wall to afford supporting said dispenser on a users hand with said strap extending around the side of the users hand opposite said dispenser;

an un-weighted mountable base having a planar attachment surface adapted to be attached to a substrate, and surfaces defining a recess along the side of the base opposite said attachment surface, said un-weighted mountable base including opposed ridges projecting into said recess and adapted to be engaged in the grooves in said dispenser by sliding the dispenser over said ridges, and having a transverse surface extending between corresponding ends of said ridges adapted to be engaged by the dispenser slid over said ridges to define full engagement of said dispenser with said un-weighted mountable base; and a weighted base having a planar bottom surface adapted to be supported on a horizontal substrate, and surfaces defining a recess along the side of the base opposite said bottom surface, said weighted base including opposed ridges projecting, into said recess and adapted to be engaged in the grooves in said dispenser by sliding the dispenser over said ridges, and having a transverse surface extending between corresponding ends of said ridges adapted to be engaged by the dispenser slid over said ridges to define full engagement of said dispenser with said weighted base.

24. A dispenser according to claim 16 wherein said bottom wall has two spaced transversely extending openings and said dispenser has parallel longitudinal grooves generally parallel to said support surface along opposite sides, and said assembly further includes:

a support member having opposed hook-like distal end portions adapted to extending through said openings and engage said bottom wall to provide means for releasably attaching the support member to the side of said bottom wall opposite said support surface, said support member having finger engagement surfaces that face in opposite directions on opposite sides of the support member shaped to engage adjacent side surfaces of a user's fingers and that include a narrow web like portion between the finger engagement surfaces adapted to comfortably extend between the fingers of a user positioned along the finger engagement surfaces, and including a retainer portion wider than the web like portion adapted to be positioned along the inner surfaces of a user's fingers, said retainer portion defining a socket opening through the side of the retainer portion opposite the web like portion;

a heavy base having an arcuate bottom surface adapted to be supported on a horizontal surface, and a spherical portion on the side of the base opposite the arcuate bottom surface removably received in the socket with said retaining portion frictionally and releasably engaging the spherical portion, said base having sufficient weight so that the sheets can be removed from the dispenser with one hand, said retainer portion being easily removable from the base by pulling it off of the spherical portion so that it can be positioned between a user's fingers to support the dispenser along the back surface of the user's fingers;

a resiliently elastic strap having opposite ends and hook-like members fixed to said opposite ends of said hooks adapted to extend through said openings and engage said bottom wall to afford supporting said dispenser on a users hand with said strap extending around the side of the users hand opposite said dispenser; and an un-weighted mountable base having a planar attachment surface adapted to be attached to a substrate, and surfaces defining a recess along the side of the base opposite said attachment surface, said un-weighted mountable base including opposed ridges projecting into said recess and adapted to be engaged in the grooves in said dispenser by sliding the dispenser over said ridges, and having a transverse surface extending between corresponding ends of said ridges adapted to be engaged by the dispenser slid over said ridges to define full engagement of said dispenser with said un-weighted mountable base; and a heavy weighted base having a planar bottom surface adapted to be supported on a horizontal substrate, and surfaces defining a recess along the side of the base opposite said bottom surface, said weighted base including opposed ridges projecting into said recess and adapted to be engaged in the grooves in said dispenser by sliding the dispenser over said ridges, and having a transverse surface extending between corresponding ends of said ridges adapted to be engaged by the dispenser slid over said ridges to define full engagement of said dispenser with said heavy weighted base.

* * * * *